United States Patent [19]

Luitz

[11] 4,361,343

[45] Nov. 30, 1982

[54] SKI BRAKE

[75] Inventor: Max Luitz, Blaichach, Fed. Rep. of Germany

[73] Assignee: Firma ESS GmbH & Co., Sonthofen, Fed. Rep. of Germany

[21] Appl. No.: 197,104

[22] PCT Filed: Feb. 20, 1980

[86] PCT No.: PCT/DE80/00018

§ 371 Date: Sep. 9, 1980

§ 102(e) Date: Sep. 9, 1980

[87] PCT Pub. No.: WO80/01651

PCT Pub. Date: Aug. 21, 1980

[30] Foreign Application Priority Data

Feb. 20, 1979 [DE] Fed. Rep. of Germany ..... 2906477

[51] Int. Cl.³ ..... A63C 7/10

[52] U.S. Cl. ..... 280/605; 188/6

[58] Field of Search ..... 280/605; 188/6

[56] References Cited

U.S. PATENT DOCUMENTS 3,933,361 1/1976 Beyl ..... 280/605

4,063,751 12/1977 Salomon ..... 280/605

4,103,916 8/1978 Krob et al. ..... 280/605

4,234,206 11/1980 Hofbauer et al. ..... 280/605

FOREIGN PATENT DOCUMENTS 2255926 7/1975 France .

2262542 9/1975 France .

2417995 9/1979 France .

*Primary Examiner*—Robert J. Spar

*Assistant Examiner*—Donald W. Underwood

*Attorney, Agent, or Firm*—Silverman, Cass & Singer, Ltd.

[57] ABSTRACT

A ski brake, which is equipped with at least one brake arm, a foot element and a spring-loaded articulated lever system arranged between the brake arm and the foot element, has a sliding crank as the articulated lever system. The crank is connected with the brake arm and the coupler forms the foot element. A sliding element is arranged spring-loaded in a housing. Joints between the foot element and the sliding element can be arranged at different levels relative to the surface of the ski. If two brake arms are used, they are connected with each other by way of a U-shaped intermediate zone.

11 Claims, 5 Drawing Figures

Fig. 1
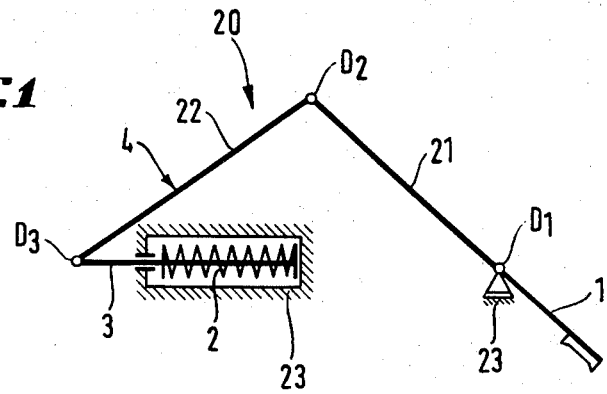
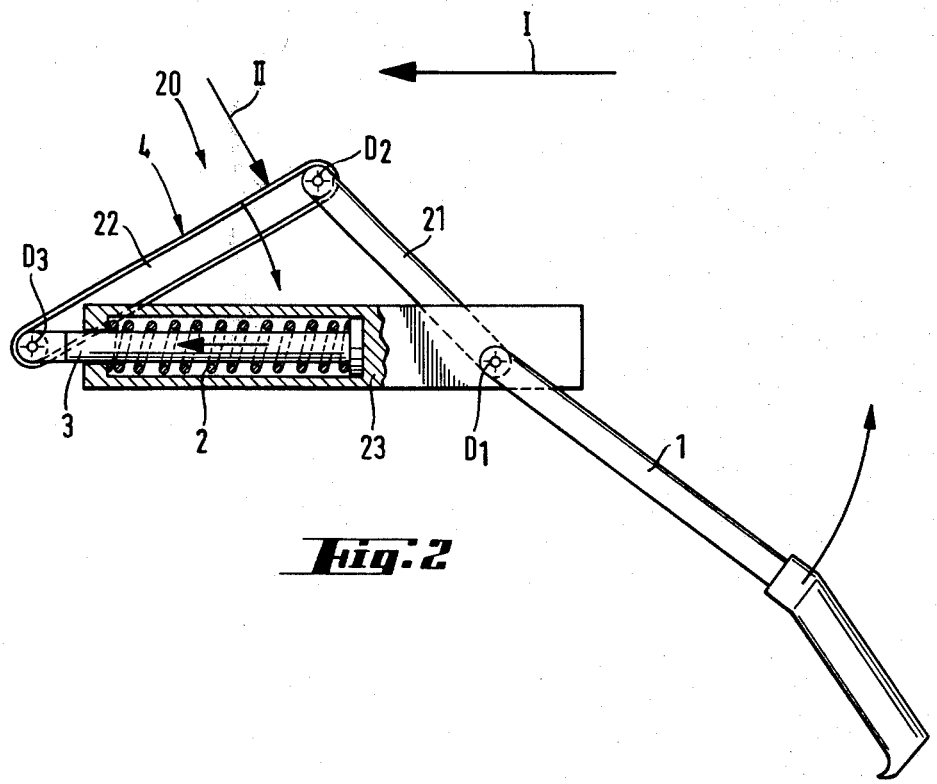
Fig. 2

SKI BRAKE

The invention relates to a ski brake having at least one brake arm, a foot element and a spring-loaded articulated lever system arranged between the brake arm and the foot element.

As a state of technique there has been known before a ski brake which is constructed in such a way that the brake arm consists of two sides connected with each other. One side is placed stationary in the housing while the other side is connected with a foot lever. A type of four-bar linkage results as an articulated lever system.

This well-known ski brake has first of all the disadvantage that the brake arm extends in the skiing direction so that an undesirable braking action and thereby injuries to the skier can occur. Moreover, a considerable stepping force is required in order to bring the ski brake out of the operating position into the position of rest.

Compared to that, the problem of the present invention consists of developing a ski brake of the aforementioned type in such a way that with little step-in distance and little force the brake arm brings about the braking of the loose ski very effectively.

As defined in the invention this problem is solved by the fact that the articulated lever system is designed as a sliding crank - with the crank being connected with a brake arm, the coupler forming the foot element and a sliding element being arranged spring-loaded in the longitudinal direction of the ski in a housing. Hereby the advantage results that because of the design of the ski brake as a sliding crank only little step-in distance is required - however, with the brake arm being swung out to a high degree and thus bringing about optimal braking.

According to another characteristic of the invention, the crank joint is arranged stationary in the housing with the joint between the foot element and the sliding element being movable in the longitudinal direction of the ski parallel to the surface of the ski. In a further development of the invention, the two joints can be arranged at different levels relative to the surface of the ski. The joint of the crank then can be located closer to the surface of the ski than the joint between the foot element and the sliding element. There results an improvement of the geometrical dimensions of the sliding crank which is present in this case as an eccentric sliding crank.

In a further development of the invention, two brake arms are connected with each other by way of a U-shaped intermediate zone - with the connecting side of the U-shaped intermediate zone being placed in the foot element and forming the joint between the crank and the foot element and with the longer side of each sliding element being spring-loaded and placed in the housing and the shorter side of each sliding element forming the joint between the foot element and the sliding element. Hereby a simple constructed form of the ski brake designed as a sliding crank results.

According to another characteristic of the invention, the two longer sides of the sliding element are placed in upright bars of the housing and each have a flange at the end - with the springs being designed as cylindrical thrust springs and placed each between the flange and a housing wall. The springs can be placed here encapsulated in the housing so that faultless protection of these springs and thereby long life is guaranteed.

In a further development of the invention, the foot element can consist of two foot bars located parallel—with each foot bar being connected, on the one hand, with the connection side of the U-shaped intermediate zone and, on the other hand, with the short side of each angular part of the sliding element.

On the other hand, however, it is also possible to design the foot element as a foot plate provided with a center opening and to connect it, on the one hand, with the connecting side of the U-shaped intermediate zone and, on the other hand, with the short side of each angular part of the sliding element. By means of this foot plate, the contact pressure brought about by the heel of the boot is advantageously transferred entirely to the eccentric sliding crank so that the ski brake can be put into the position of rest without exerting great force.

According to another characteristic of the invention, the crank can be designed bent at an angle in the longitudinal direction of the ski between the joint which is stationary in the housing and the joint connected with the foot element. By this bend in the crank arm there results advantageously an improvement of the pushing force and thereby easier moving of the ski brake. The bent zone of the crank arm is located here approximately tangentially to the swivel path of the foot plate.

Accordingly to another characteristic of the invention, the housing is provided with a centering crosspiece, a leaf spring with a detent connected therewith - a guide that works together with the centering crosspiece and a locking element that works together with the detent and is arranged on the top side of the ski. By means of these elements it is possible to attach the ski brake as defined in the invention removably on the top side of the ski.

In the following the invention is described in detail by means of embodiments illustrated in the drawing.

In the drawing

FIG. 1 shows a schematic side view of the ski brake designed as a sliding crank;

FIG. 2 shows a constructed embodiment of the ski brake according to FIG. 1;

Figure 3:
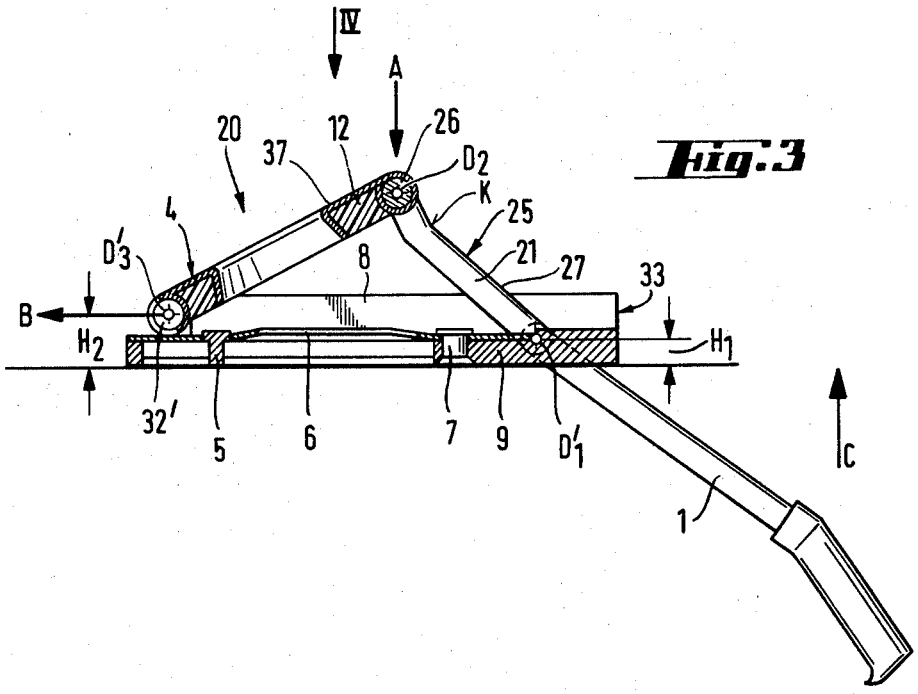
FIG. 3 shows another embodiment of the ski brake as an eccentric sliding crank, in a side sectional view, along the line III—III of FIG. 4.

The ski brake illustrated in FIGS. 1 and 2 is designed as an eccentric sliding crank and has a crank 21 connected with a brake arm 1, a coupler 22 which forms a foot element 4, as well as a sliding element 3. Said sliding element 3 is loaded by a spring 2 which is placed or contained in a housing 23. Between the sliding element 3 and a foot element 4 there is the point of rotation $D_3$ such as a joint. A point of rotation $D_2$ is arranged between a foot element 4 and the crank 21 and the crank 21 is placed above a point of rotation $D_1$ in the housing.

In FIG. 2 the sliding crank illustrated schematically in FIG. 1 is developed constructually. Here it is evident that the housing 23 serves as a bearing point for the point of rotation $D_1$ and as a bearing for the pressure spring 2. Since the running direction of the ski is in the direction of the arrow I according to FIG. 2, the skis cannot get caught - not even in the case of an undesired release of the brake - so that the danger of accidents is avoided. If pressure is exerted on the foot element 4 in the direction of the arrow II by way of the heel of a boot which is not shown, this foot element 4 moves clockwise around the point of rotation $D_1$ and thereby gets into the position of rest.

Figure 4:
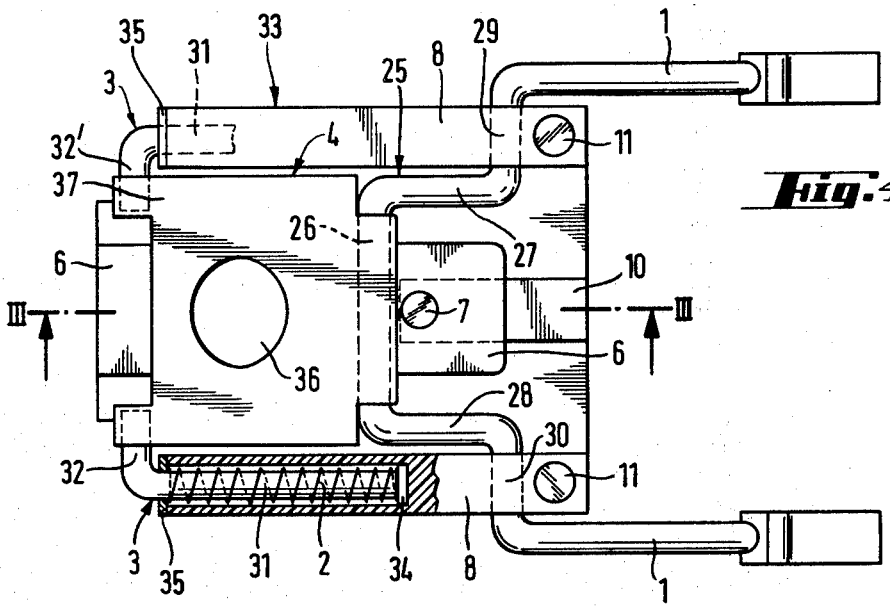
FIG. 4 shows a top view of the ski brake illustrated FIG. 3.

In FIGS. 3 and 4, a ski brake as defined in the invention is illustrated on which an eccentric sliding crank is used. Here is can be seen that the point of rotation $D'_1$ is at a distance $H_1$ from the top side of the ski, or the bottom side surface of the ski brake, whereas the point of rotation $D'_3$ is at a distance $H_2$ from the top side of the ski or the bottom side surface of the ski brake. Because of this eccentricity there results an improvement of the geometric proportions and thereby a facilitating of the handling of the ski brake as defined in the invention.

As it can be seen, two brake arms 1 exist here which are connected to a connection side 26 of a U-shaped intermediate zone 25 by way of two bearing zones 29 and 30, respectively, as well as by two connecting sides 27 and 28, respectively. The two bearing zones 29 and 30 are placed or located rotatable in the housing 33 of the ski brake and represent the points of rotation $D'_1$.

In the present case, the foot element 4 is designed as a foot plate 37 having a center opening 36. The joint between the foot plate 37 and the connection side 26 represents the other joint, namely $D_2$.

The two sliding elements 3 are designed as angular parts and each have a shorter side 32, 32', respectively, as well as a longer side 31. The shorter side 32 or 32' is articulatedly connected with the foot plate 37 and thereby forms the joint $D'_3$. The longer side of each sliding element 3 is arranged within two upright bars 8 which are arranged parallel to the housing and connected to it to form one piece. Each longer side 31 has a flange 34 on one end. Furthermore, inside the upright bar 8 there is provided a pressure spring 2 which, on the one hand, abuts against the flange 34 and, on the other hand, against a housing wall 35. Thereby the spring 2 is located encapsulated within the housing 33.

The foot element 4 designed as a foot plate 37 has a holding plate 12 whereby an improvement of the bearings for the individual joints results. Furthermore, it is evident from FIG. 3 that the crank 21 of the sliding crank 20 has an angular bend K whereby an improvement of the pushing force results. If one steps on the foot element 4 in the direction of the arrow A, the point of rotation $D'_3$ moves in the direction of the arrow B whereby the two brake arms move in the direction of the arrow C and thereby bring about the closing of the brake. Because of the angular bend K, part of the crank 21 is advantageously located tangentially to the swivel path of the foot element 4 described by an arc drawn around the third point of rotation $D_3$.

It is also possible to design the foot element 4 not as a foot plate but to provide it merely with two parallel foot bars (not shown in detail). Hereby, too, there results advantageously a small step-in distance and advantageously also a narrow type of construction.

Because of the special geometrical dimensions of the ski brake designed as an eccentric sliding crank, the swinging of the rest brake arms into the position requires only little force whereas with the release of the force great energy is freed and thereby brings the brake arms faultlessly into the braking function.

According to FIGS. 3 and 4, the housing 33 is provided with a leaf spring 6 as well as with a detent 5 connected with the leaf spring. The leaf spring 6 is fastened on the housing 33 by way of a rivet 7. Furthermore, the housing has a centering crosspiece 10 according to FIG. 4. Hereby it is possible, for instance, to attach the ski brake as defined in the invention removably on the top side of the ski—with the centering crosspiece 10 making possible accurate guiding in the longitudinal direction of the ski by means of a guide attached on the top side of the ski and not shown in detail—with a locking element, which works together with the detent 5 and is not shown in detail, bringing about the locking of the ski brake on the top side of the ski.

Furthermore it is possible to design the two brake arms 1 in such a way that the skis can be fastened against each other without a ski clip when they are not used.

The two upright bars 8 shown in FIG. 4 consist here advantageously of plastic and are each fastened on the housing 33 by way of the rivet 11. The plate 12 shown in FIG. 3 is also a plastic part which is covered with a metal part—with the two parts forming the foot element 4. By the flanging of the metal parts there result the two points of rotation $D_2$ and $D'_3$.

If one raises the front part of the leaf spring 6 shown in FIG. 4, the detent 5 is no longer engaged with the locking element which is fastened on the surface of the ski and not shown in detail. Thereby the entire ski brake can be demounted from the ski in a simple manner by moving the ski brake in the longitudinal direction of the ski until the centering crosspiece 10 is no longer in engagement with the guide on the top side of the ski which is not shown in detail.

Altogether there results thereby a ski brake designed as an eccentric sliding crank which is highly effective, has a narrow type of construction and requires only little step-in distance. Moreover, it has a long life span because of the encapsulation of the most important elements.

Because of the special geometric dimensions of the eccentric sliding crank it is advantageously possible that in the position of rest, i.e. in the position where the foot plate 4 is located parallel to the surface of the ski, almost no vertical force acts on the joint $D_2$ so that the heel of the boot remains load-free. However, as soon as the crank 21 and the foot element 4 are at a certain angle with each other, the force of the two pressure springs acts stronger and stronger so that the holding force of the brake arms 1 also becomes increasingly stronger until it finally reaches the optimum in the open position of the brake arms 1.

Figure 5:
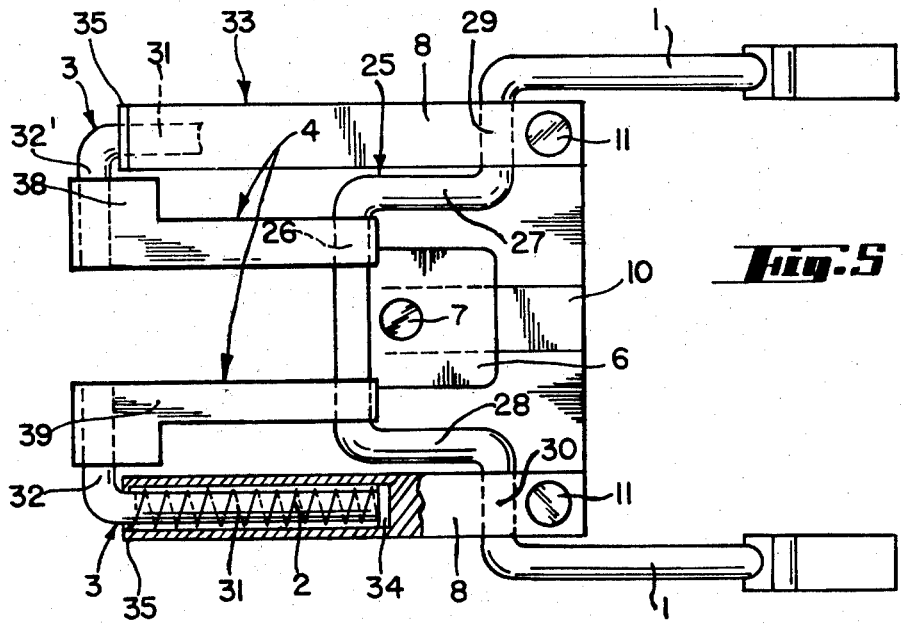
FIG. 5 shows another embodiment of the ski brake.

In FIG. 5, a ski brake as defined in the invention is illustrated on which two parallel foot bars 38 and 39 are used for the coupler or foot element 4. Foot bar 38 is joined to the shorter end 32' of one sliding element 3 and the U-shaped, intermediate zone 25 while foot bar 39 is joined to the shorter end 32 of the other sliding element 3 and the U-shaped intermediate zone 25. The two foot bars 38 and 39 are arranged parallel one another in the direction of the length of the ski.

I claim:

1. A ski brake comprising:

A. at least one brake arm, and

B. a spring loaded, articulated lever system including:

i. a crank that is connected to said brake arm by a first joint, ii. a coupler that presents a foot element and that is joined to the crank by a second joint, and iii. a sliding element that is arranged to be spring-loaded in a housing, a portion of the sliding element extending from an end of the housing and being connected to the coupler by a third joint.

2. The ski brake as claimed in claim 1 in which the ski brake has a length adapted to be arranged substantially parallel with the length of a ski, the first joint being arranged stationary on the housing and the third joint being movable along the length of the ski brake.

3. The ski brake as claimed in claim 2 in which the ski brake presents a bottom-side surface adapted to be installed on the planar, top-side surface of said ski and the first and third joints are arranged at different levels above said bottomside surface to form an eccentric sliding crank.

4. The ski brake as claimed in claim 3 in which the first joint is closer to the bottom-side surface of the ski brake than the third joint.

5. The ski brake as claimed in claims 1, 2, 3 or 4 in which there are two brake arms and two cranks connected together by a U-shaped, intermediate portion forming a portion of the second joint, and the sliding element comprising two angular parts each having a longer portion and a shorter portion, the longer portions each being engaged with a spring in said housing and the shorter portions extending from said housing forming portions of the third joint.

6. The ski brake as claimed in claim 5 in which the housing presents two walls through which the shorter portions extend, the end of each longer portion opposite its shorter portion having a flange and the springs being carried by the longer portions between the flanges and the walls.

7. The ski brake as claimed in claim 6 in which the springs are arranged encapsulated in the housing.

8. The ski brake as claimed in claim 5 in which the coupler is formed of two parallel foot bars, each being connected at one end to the U-shaped, intermediate portion of the cranks and at the other end to one of the shorter portions of the angular parts.

9. The ski brake as claimed in claim 5 in which the coupler is formed of a foot plate provided with a center opening and is connected along one edge with the U-shaped, intermediate portion of the cranks and along another edge with the shorter portions of the angular parts.

10. The ski brake as claimed in claim 5 in which the cranks are bent to form a portion tangential to an arc drawn around the third joint.

11. The ski brake as claimed in claim 1 in which a ski is provided with mounting means for detachably mounting the ski brake on the ski, the mounting means including a centering crosspiece mating with structure carried on a ski for arranging the ski brake on the ski and a leaf spring and detent combination operating together with additional structure on the ski to detachably lock the ski brake on the ski.

* * * * *